US009415479B2

(12) United States Patent
Lin et al.

(10) Patent No.: US 9,415,479 B2
(45) Date of Patent: Aug. 16, 2016

(54) CONDUCTIVE CHEMICAL MECHANICAL PLANARIZATION POLISHING PAD

(71) Applicant: Taiwan Semiconductor Manufacturing Co., Ltd., Hsin-Chu (TW)

(72) Inventors: Chang-Sheng Lin, Baoshan Township (TW); Hsin-Hsien Lu, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 286 days.

(21) Appl. No.: 13/762,414

(22) Filed: Feb. 8, 2013

(65) Prior Publication Data

US 2014/0227951 A1 Aug. 14, 2014

(51) Int. Cl.
*B24B 37/24* (2012.01)
*B24B 37/26* (2012.01)

(52) U.S. Cl.
CPC ..... *B24B 37/24* (2013.01); *B24B 37/26* (2013.01)

(58) Field of Classification Search
CPC ..... Y10T 428/21; Y10T 428/213; Y10T 428/2457; Y10T 428/24802; B24B 37/11; B24B 37/14; B24B 37/16; B24B 37/24; B24B 37/26
See application file for complete search history.

(56) References Cited

U.S. PATENT DOCUMENTS

| | | | | |
|---|---|---|---|---|
| 6,848,977 | B1 * | 2/2005 | Cook et al. | 451/41 |
| 6,979,248 | B2 * | 12/2005 | Hu et al. | 451/28 |
| 7,059,948 | B2 * | 6/2006 | Li et al. | 451/527 |
| 7,422,516 | B2 | 9/2008 | Butterfield et al. | |

FOREIGN PATENT DOCUMENTS

TW 200402100 A 2/2004

OTHER PUBLICATIONS

Official Action issued in counterpart Taiwan Patent Application.

* cited by examiner

*Primary Examiner* — Gerard Higgins
(74) *Attorney, Agent, or Firm* — Duane Morris LLP

(57) ABSTRACT

A polishing pad for polishing a substrate. The pad comprises a layer of material having an upper polishing surface and a lower surface interfacing with a proximate platen, the material comprising a mixture of a conductive polymer distributed in a structure of a dielectric polymeric material using predetermined relationships. Additional embodiments provide a pad having a layer of dielectric polymeric material with an upper polishing surface and a lower surface interfacing with a proximate platen. A first set of grooves filled with a conductive polymer extends from the upper polishing surface to the lower surface, the first set of grooves filled with a conductive polymer. A second set of shallower grooves provide for slurry flow over the upper polishing surface. The first and/or second set of grooves are provided in a predetermined pattern.

20 Claims, 5 Drawing Sheets

CONDUCTIVE CHEMICAL MECHANICAL PLANARIZATION POLISHING PAD

BACKGROUND

In the fabrication of integrated circuits and other electronic devices, multiple layers of conducting, semiconducting, and dielectric materials are deposited on or removed from a surface of a substrate or wafer. Thin layers of conducting, semiconducting, and dielectric materials can be deposited by a number of deposition techniques. Common deposition techniques in modern processing include physical vapor deposition (PVD), also known as sputtering, chemical vapor deposition (CVD), plasma-enhanced chemical vapor deposition (PECVD), and electro-chemical plating (ECP).

As layers of materials are sequentially deposited and removed, the uppermost surface of the substrate or wafer can become non-planar and require planarization. Planarizing or "polishing" a surface is a process where material is removed from the surface of the substrate to form a generally even, planar surface. Planarization is useful in removing undesired surface topography and surface defects, such as rough surfaces, agglomerated materials, crystal lattice damage, scratches, and contaminated layers or materials. Planarization is also useful in forming features on a substrate by removing excess deposited material used to fill the features and in providing an even surface for subsequent levels of metallization and processing.

Chemical mechanical planarization, or chemical mechanical polishing (CMP), is a common technique used to planarize substrates or wafers. CMP utilizes a chemical composition, typically a slurry or other fluid medium, for selective removal of material from substrates. In conventional CMP techniques, a substrate carrier or polishing head is mounted on a carrier assembly and positioned in contact with a polishing pad in a CMP apparatus or machine. The carrier assembly provides a controllable pressure to the substrate urging the substrate against the polishing pad. The pad is moved relative to the substrate by an external driving force. The CMP apparatus effects polishing or rubbing movement between the surface of the substrate and the polishing pad while dispersing a polishing composition to effect chemical activity and/or mechanical activity and consequential removal of material from the surface of the substrate.

The tribological interactions between the substrate and the polishing pad introduces static electricity inducing local damage to the substrate wafer and any devices thereon. Conventional CMP machines or systems increase the conductivity of the slurry to counteract static electricity; however, due to topographical and/or wear effects on the polishing pad, conductive slurries can still result in local damage in the substrate due to static electricity. Thus, there is a need for an improved polishing pad to reduce the incidence of static electricity in exemplary CMP processes.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features can be arbitrarily increased or reduced for clarity of discussion.

DETAILED DESCRIPTION

Figure 1:
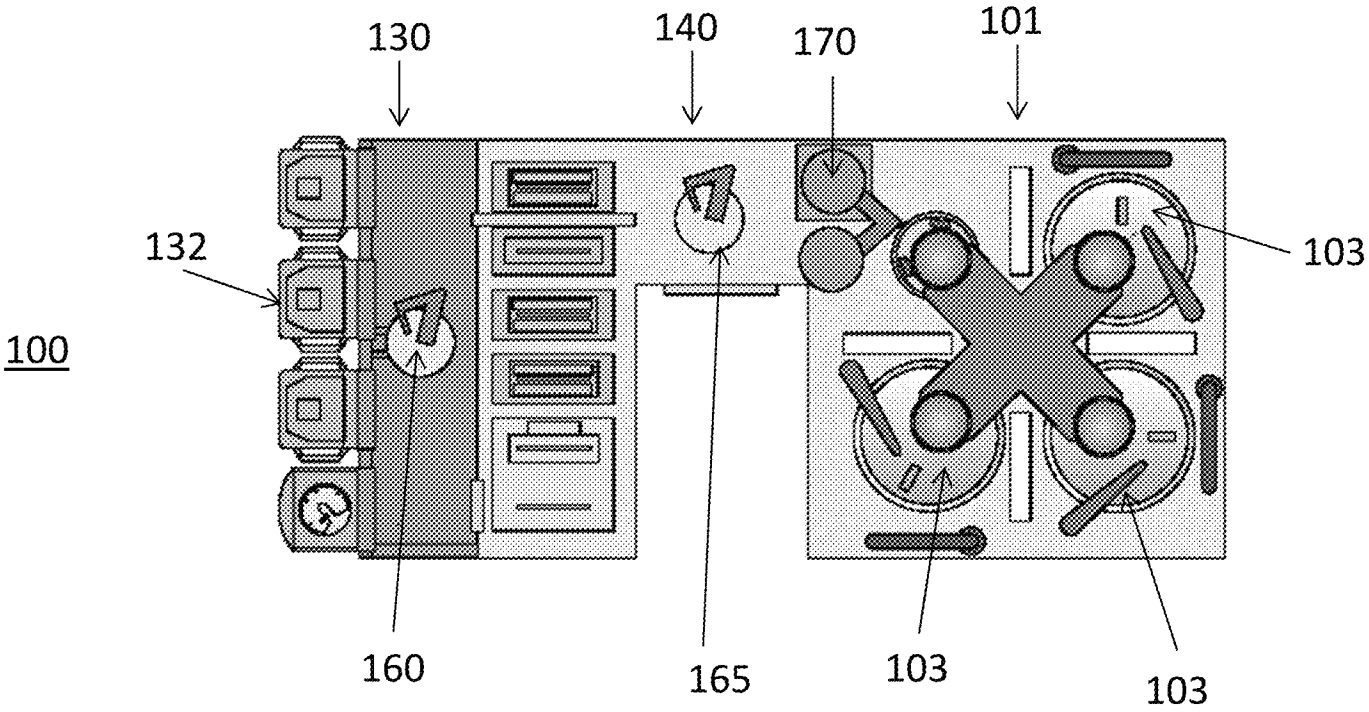
FIG. 1 is a top view of a chemical mechanical planarization tool.

It is understood that the following disclosure provides many different embodiments or examples for implementing different features of various embodiments. Specific examples of components and arrangements are described below to simplify the present disclosure. These are, of course, merely examples and are not intended to be limiting. The present disclosure may repeat reference numerals and/or letters in the various examples. This repetition is for the purpose of simplicity and clarity and does not in itself dictate a relationship between the various embodiments and/or configurations discussed.

Terms used herein are only used to describe the specific embodiments, which are not used to limit the claims appended herewith. For example, unless limited otherwise, the term "one" or "the" of the single form may also represent the plural form. The terms such as "first" and "second" are used for describing various devices, areas and layers, etc., though such terms are only used for distinguishing one device, one area or one layer from another device, another area or another layer. Therefore, the first area can also be referred to as the second area without departing from the spirit of the claimed subject matter, and the others are deduced by analogy. Moreover, space orientation terms such as "under", "on", "up", "down", etc. are used to describe a relationship between a device or a characteristic and another device or another characteristic in the drawing. It should be noted that the space orientation term can cover different orientations of the device besides the orientation of the device illustrated in the drawing. For example, if the device in the drawing is turned over, the device located "under" or "below" the other devices or characteristics is reoriented to be located "above" the other devices or characteristics. Therefore, the space orientation term "under" may include two orientations of "above" and "below". It should be noted that the terms "wafer" and "substrate" are used interchangeably in the present disclosure and such use should not limit the scope of the claims appended herewith.

Figure 2:
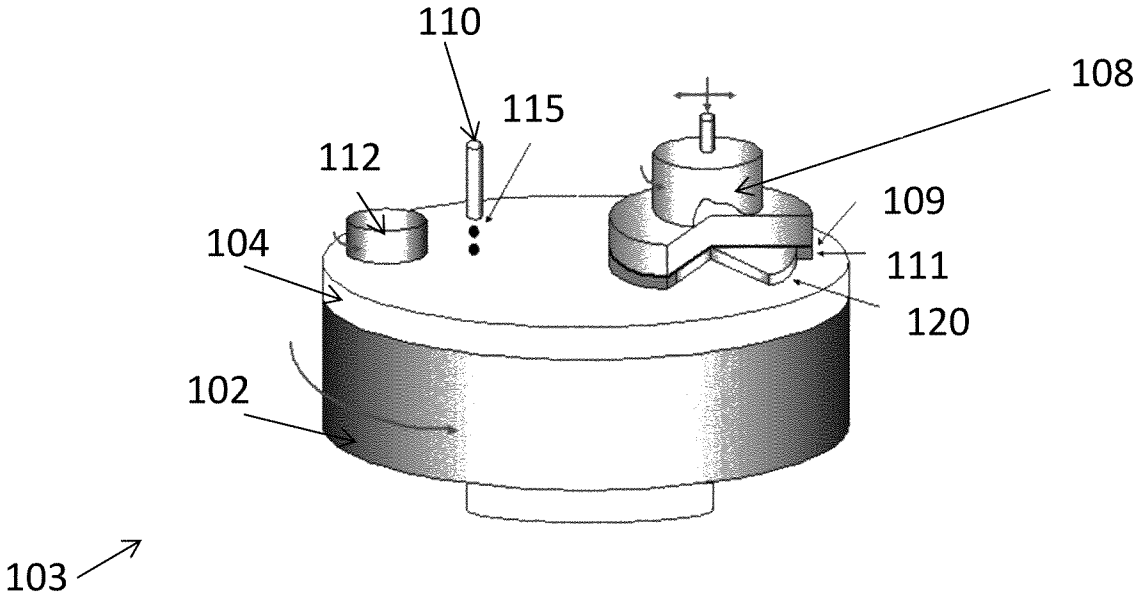
FIG. 2 is a perspective view of the platen, pad and head components of the tool depicted in FIG. 1.

FIG. 1 is a top view of a chemical mechanical planarization tool. FIG. 2 is a perspective view of the platen, pad and head components of the tool depicted in FIG. 1. With reference to FIGS. 1 and 2, one or more semiconductor wafers can be subjected to a chemical mechanical planarization or polishing (CMP) process using an exemplary CMP system 100. An exemplary CMP system 100 generally includes a factory interface 130, a cleaning module 140 and a polishing or planarization module 101. In some embodiments, a dry robot 160 is provided to transfer substrates or wafers between the factory interface 130 and the cleaning module 140, and a wet robot 165 is provided to transfer substrates or wafers between the cleaning module 140 and the planarization module 101. While not shown, in other embodiments the wet robot 165 can be configured to transfer substrates or wafers between the factory interface 130, cleaning module 140 and/or the polishing module 101.

The factory interface 130 generally includes the dry robot 160 which is configured to transfer substrates or wafers between one or more cassettes 132 and the cleaning module 140. In the embodiment depicted in FIG. 1, four storage cassettes 132 are shown, however, embodiments according to the present disclosure should not be so limited as any number of cassettes are envisioned. The dry robot 160 generally has sufficient range of motion to facilitate transfer between the storage cassettes 132 and the cleaning module 140. Optionally, the range of motion of the dry robot 160 can be increased by adding additional linkages to the robot or placing the robot on a rail mechanism. As depicted, the dry robot 160 is also configured to receive substrates or wafers from the cleaning module 140 and return cleaned, polished substrates or wafers to the substrate storage cassettes 132. The wet robot 165 generally has sufficient range of motion to transfer substrates or wafers between the cleaning module 140 and one or more load cups 170 disposed on the planarization module 101. Range of motion of the wet robot 165 can also be increased by adding additional linkages to the robot or placing the robot on a rail mechanism.

The planarization module 101 includes a plurality of planarization stations 103 each having one or more rotating tables or platens 102 covered by a polishing pad 104. In some embodiments of the present disclosure, the polishing pad 104 can be adhered to the platen 102 by any conventional means including pressure sensitive adhesion or through a vacuum system described in co-pending U.S. Application No. 13/762,412 (filed Feb. 8, 2013), the entirety of which is incorporated herein by reference. Polishing pads 104 according to embodiments of the present disclosure can include suitable dielectric polymeric materials including, but not limited to, polyamides, polyimides, nylon polymer, polyurethane, polyester, polypropylene, polyethylene, polystyrene, polycarbonate, diene containing polymers, such as AES (polyacrylontrile ethylene styrene), acrylic polymers, or combinations thereof. Embodiments of the present disclosure also contemplate the use of organic or inorganic materials that can be used as in exemplary polishing pads.

Some embodiments of the present disclosure introduce or distribute a conductive polymer into the structure of the aforementioned dielectric polymeric materials. Exemplary conductive polymers include, but are not limited to, carbon-based materials, conductive ceramic material, conductive alloys, any suitable dielectric polymeric materials described above coated with a conductive material, or combinations thereof. Additional conductive polymers include, but are not limited to, intrinsically conductive polymeric materials such as polyacetylene, polyethylenedioxythiophene (PEDT), polypyrrole, polythiophene, polyethyne, polyaniline, poly (p-phenylene), poly (phenylene vinylene), or combinations thereof. For example, in various embodiments of the present disclosure a conductive polymer "$CP_Y$" can be introduced into a dielectric polymeric structure during formation (or reaction) of the respective polymeric material, in this non-limiting example polyurethane, between the respective first component "$A_X$" or polyol in the case of polyurethane and second component "$B_Z$" or diisocyanate in the case of polyurethane using any of the following relationships or combination thereof:

$$—\{B_Z\text{-}A_X\text{-}CP_Y—B_Z\text{-}A_X\text{-}CP_Y\}_n— \quad (1)$$

$$—\{B_Z—CP_Y\text{-}A_X\text{-}CP_Y—B_Z—CP_Y\text{-}A_X\text{-}CP_Y\}_n— \quad (2)$$

Of course, any polymeric material can be employed in the underlying structure and the aforementioned example utilizing polyurethane should not limit the scope of the claims appended herewith. Such exemplary conductive pad materials having a polymeric structure selectively interspersed with conductive polymers can provide exemplary conductivities of approximately $10^{-5}$ S/cm to approximately $10^{5}$ S/cm, a hardness of approximately 10 Shore A to approximately 80 Shore D or equivalent, densities of approximately 0.2 g/ml to approximately 1.2 g/ml, and compressibilities of approximately 1% to 20% when the weight percentage of the conductive polymer is less than or equal to approximately fifty percent of the total weight.

Figure 3:
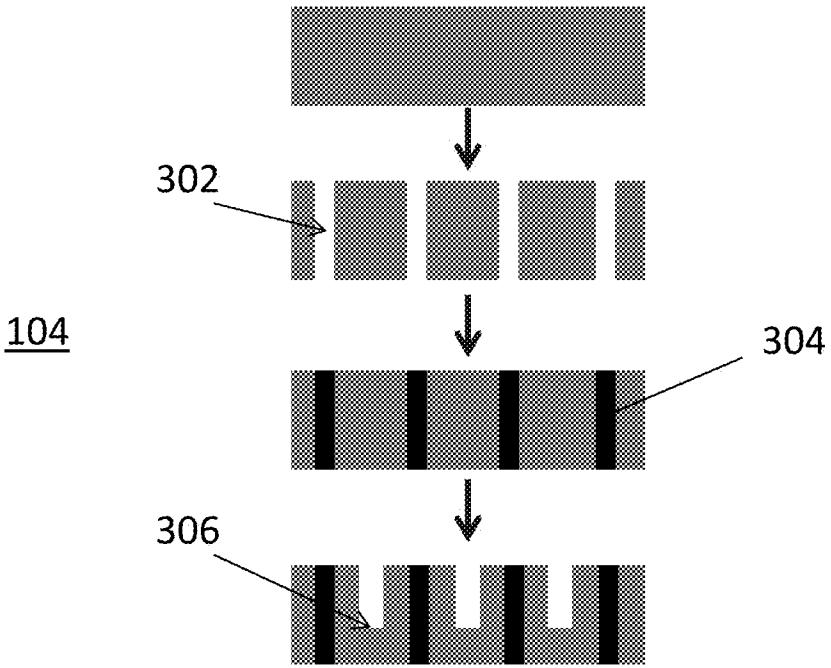
FIG. 3 is an illustration of a cross section of an exemplary polishing pad according to various embodiments of the present disclosure.

FIG. 3 is an illustration of a cross section of an exemplary polishing pad according to various embodiments of the present disclosure. With reference to FIG. 3, embodiments of the present disclosure can introduce a conductive polymer into grooves, holes, or channels in an exemplary polishing pad 104 rather than integrating the conductive polymer into the dielectric polymeric material structure as discussed above. Additionally, alternative embodiments of the present disclosure can provide a combination of the selective interspersion of conductive polymer into the dielectric polymeric material structure as described above as well as provide conductive polymer grooves or channels. In the embodiments depicted in FIG. 3, the polishing pad 104 can be formed from any suitable polymeric material including, but not limited to, polyamides, polyimides, nylon polymer, polyurethane, polyester, polypropylene, polyethylene, polystyrene, polycarbonate, diene containing polymers, such as AES, acrylic polymers, or combinations thereof. Embodiments of the present disclosure also contemplate the use of organic or inorganic materials that can be used as in exemplary polishing pads. Exemplary conductive polymers include, but are not limited to, carbon-based materials, conductive ceramic material, conductive alloys, suitable dielectric polymeric materials described above coated with a conductive material, or combinations thereof. Additional conductive polymers include, but are not limited to, intrinsically conductive polymeric materials such as polyacetylene, PEDT, polypyrrole, polythiophene, polyethyne, polyaniline, poly (p-phenylene), poly (phenylene vinylene), or combinations thereof. With continued reference to FIG. 3, an exemplary polishing pad 104 includes a first groove 302 or a pattern or series of grooves extending from one surface of the pad to an opposing surface of the pad, that is, from the pad surface facing a wafer to the pad surface interfacing with a respective platen (not shown). This first groove 302 can be formed using any suitable method including, but not limited to, machining by computer numerical controlled cutting, and the like. The first groove 302 is then filled or plugged with a suitable conductive polymer 304 as discussed above. The width of the first groove or conductive polymer filled groove 302 can be between approximately 1 mil to approximately 30 mils, e.g., substantially equal or less than the milled or cut groove width. Exemplary conductive polymer filled grooves 302 can be disposed in the polishing pad surface in any pattern including, but not limited to, linear grooves, arcuate grooves, annular concentric grooves, radial grooves, helical grooves, and other shapes that facilitate slurry flow across the polishing pad surface. Further, the conductive polymer filled grooves 302 can also intersect and can be configured into patterns, such as an intersecting X-Y pattern, an intersecting triangular pattern, etc.

In additional embodiments of the present disclosure, a second groove 306 or pattern of grooves can be formed between the conductive polymer filled grooves 302 or in other locations on the surface of the polishing pad. Any number of conductive polymer filled grooves 302 can be provided between two adjacent second grooves 306, e.g., 1-30 conductive polymer filled grooves or lines between two successive second grooves 306. The second groove 306 can be formed using any suitable method including, but not limited to, machining by computer numerical controlled cutting, and the like, and can be cut to any suitable depth to promote flow of slurry during CMP processing. Exemplary second grooves 306 can be disposed in the polishing pad surface in any pattern including, but not limited to, linear grooves, arcuate grooves, annular concentric grooves, radial grooves, helical grooves, and other shapes that facilitate slurry flow across the polishing pad surface. The second grooves 306 can intersect and can be configured into patterns, such as an intersecting X-Y pattern, an intersecting triangular pattern, etc. to improve slurry flow. The second grooves 306 can be spaced between approximately 30 mils and approximately 300 mils apart from one another. Width of exemplary second grooves 306 can be between approximately 1 mil to approximately 30 mils. Of course, groove width can vary in size as required for polishing. Any suitable groove configuration, size, diameter, cross-sectional shape, or spacing can be employed in embodiments of the present disclosure to provide adequate slurry flow over the pad surface.

Figure 4C:
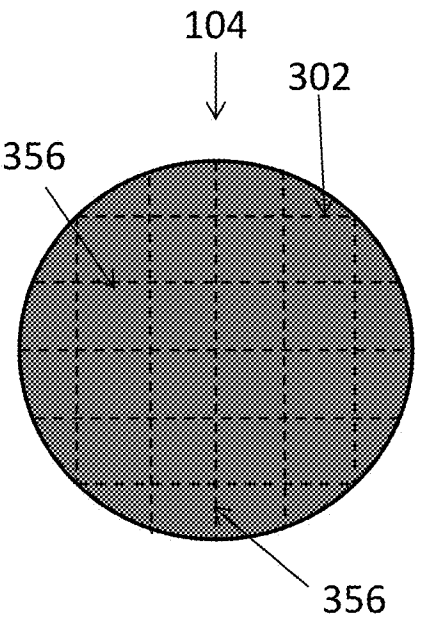
FIGS. 4A-4F are top views of exemplary chemical mechanical planarization polishing pads according to the present disclosure.
Figure 4B:
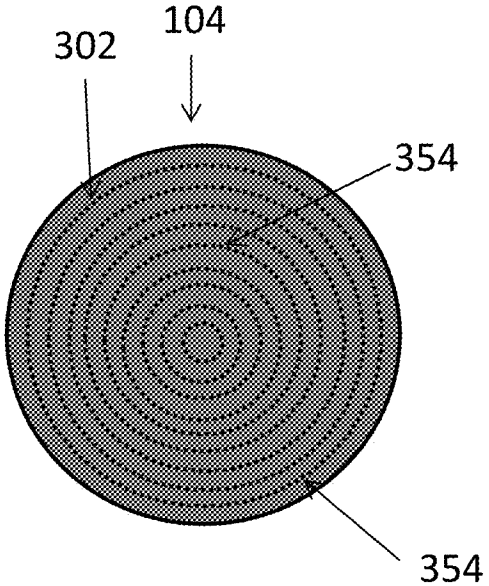
Figure 4A:
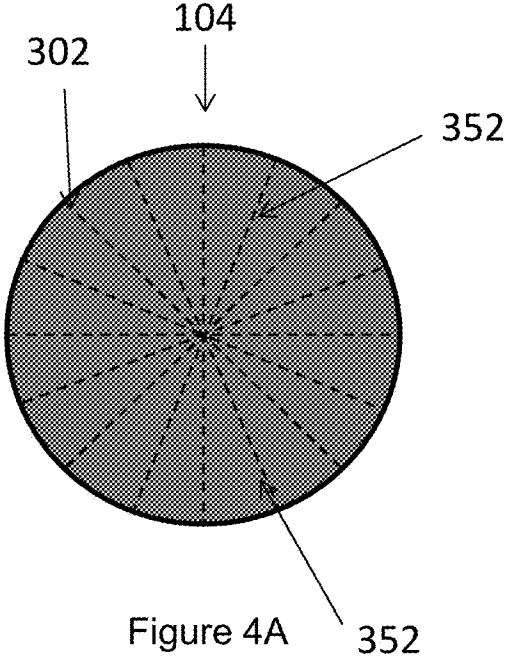
Figures 4D, 4E, 4F:
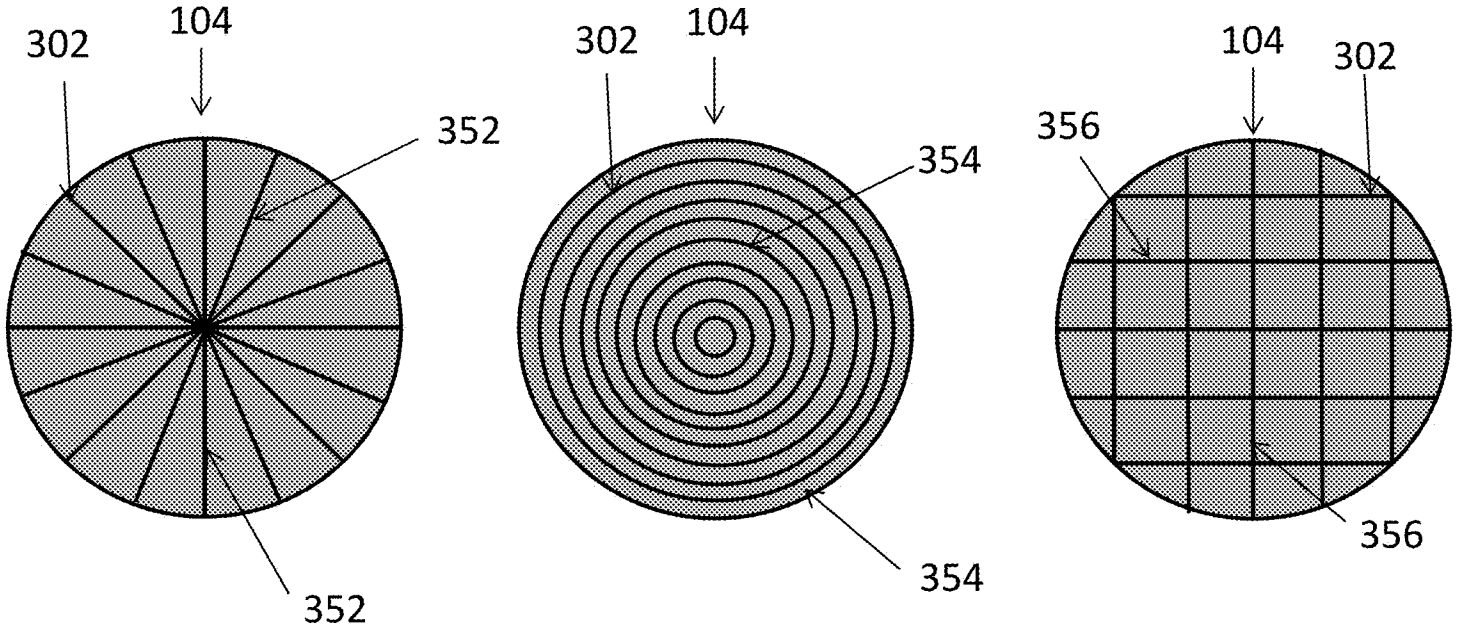

FIGS. 4A-4F are top views of exemplary chemical mechanical planarization polishing pads according to the present disclosure. With reference to FIGS. 4A-4C, conductive polymer filled grooves 302 can be configured on an exemplary polishing pad 104 as a series of distributed holes or discontinuous grooves. As depicted in FIG. 4A, the holes or discontinuous grooves 302 can be radially distributed on the surface of the pad 104, e.g., distributed along a plurality or series of radial lines 352 emanating from a central node of the pad 104. In some embodiments, the holes or discontinuous grooves 302 can be concentrically distributed on the surface of the pad 104, e.g., distributed along a pattern of plural concentric circles 354 as illustrated in FIG. 4B. In other embodiments, the holes or discontinuous grooves 302 can be distributed along a pattern of grid lines 356 on the surface of the pad 104 as illustrated in FIG. 4C. Of course, the embodiments depicted in FIGS. 4A-4C are exemplary only and should not limit the scope of the claims appended herewith as any hole or groove shape, size, pitch, number and distribution pattern is envisioned by the present disclosure. For example, embodiments of the present disclosure can include any symmetrical or asymmetrical hole or groove pattern or combination thereof, can include various hole or groove shapes, sizes, pitches (i.e., the distance between similar edges or points of adjacent holes or grooves), and can include any number of holes or grooves in any pattern or combination of patterns. FIGS. 4D-4F provide additional embodiments of the present disclosure having continuous grooves radially distributed on the surface of the pad 104 (FIG. 4D), continuous grooves 302 concentrically distributed on the surface of the pad 104 (FIG. 4E), and continuous grooves 302 distributed along a pattern of grid lines on the surface of the pad 104 (FIG. 4F). Any number of continuous or discontinuous grooves (e.g., 2 to 1000) can be utilized in embodiments of the present disclosure. In some embodiments, the area percentage of the conductive polymer is less than or equal to approximately forty percent of the total pad area. Thus, through such exemplary polishing pads 104 and respective distribution of holes, discontinuous grooves and/or continuous grooves, prevention of damaging defects can be effected which normally results from tribological interactions between the substrate and the polishing pad induced by static electricity.

With continued reference to FIGS. 1 and 2, a wafer 120 being polished is generally mounted upside down in a carrier, head or spindle 108. The carrier, head or spindle 108 is adaptable to accept wafers from and return wafers to the load cup 170. Wafers 120 can be held by vacuum to the carrier, head or spindle 108 or held thereto by a backing film 109. In some embodiments the wafer 120 is encompassed by a retainer ring 111. A slurry 115 can be introduced on the polishing pad 104 via a slurry introduction mechanism 110. Exemplary slurries 115 comprise an abrasive(s) suspended in an alkaline, neutral or acidic solution, depending upon the process requirement, i.e., chemical etchants and colloid particles. Pad conditioners 112 can also be employed to prepare and condition the surface of the pad 104 during, before and/or after CMP processes. The polishing spindle 108 is generally rotated with different axes of rotation to remove material and even out irregular topographies on the semiconductor wafer 120. The rotating polishing spindle 108 presses the semiconductor wafer 120 against the rotating polishing pad 104 and slurry 115 containing chemical etchants and colloid particles are introduced using the slurry introduction mechanism 110 onto the polishing pad 104. Through this active rotation of a wafer 120 on a polishing platen 102 and pad 104 under pressure in a presence of a polishing medium, irregularities on the wafer surface are removed during one or more CMP processes thereby resulting in a planarization of the semiconductor wafer 120.

An exemplary CMP system 100 can achieve global planarization of respective wafer surfaces and can be utilized to planarize all types of surfaces including, but not limited to, multi-material surfaces. During an exemplary CMP process, chemical reaction facilitates the formation of surface layers on the wafer being polished which is reactively softer than the original surface. Subsequent mechanical removal of these softer surface layers occurs through abrasion with the polishing pad 104. It should be understood that the one or more CMP processes can encompass any combinations of CMP processes. For example, only one CMP process is used in some embodiments. In other embodiments, the one or more CMP processes include a first and a second CMP process, and different types of slurry are used in the performing the first and second CMP processes. The wafer can include any suitable semiconductor material including, but not limited to, silicon, germanium, a compound semiconductor, and a semiconductor-on-insulator (SOI) substrate. A compound semiconductor can be an III-V semiconductor compound such as gallium arsenide (GaAs). An SOI substrate can comprise a semiconductor on an insulator such as glass. Other portions (not shown) of a semiconductor device can be formed on the wafer including, but not limited to, a buffer layer, an isolator layer or isolation structure such as a shallow trench isolation (STI) structure, a channel layer, a source region and a drain region.

Some embodiments of the present disclosure provide an exemplary polishing pad for polishing a substrate, the pad comprising a layer of material having an upper polishing surface and a lower surface interfacing with a proximate platen. The pad material comprises a mixture of a conductive polymer ($CP_Y$) distributed in a structure of a dielectric polymeric material, the structure defined by a first component ($A_X$) and a second component ($B_Z$) in the relationship —$\{B_Z$-$A_X$-$CP_Y$—$B_Z$-$A_X$-$CP_Y\}_n$— where n represents a predetermined number of molecular units. Some embodiments of the present disclosure provide a conductivity of between approximately $10^{-5}$ S/cm to approximately $10^5$ S/cm, a hardness of between approximately 10 Shore A to approximately 80 Shore D, a density of between approximately 0.2 g/ml to approximately 1.2 g/ml and/or a compressibility of between approximately 1% to approximately 20%. In other embodiments, the weight percentage of the conductive polymer is less than or equal to approximately fifty percent of the total weight of the pad. Exemplary dielectric polymeric material can be, but is not limited to, polyamides, polyimides, nylon polymer, polyurethane, polyester, polypropylene, polyethylene, polystyrene, polycarbonate, diene containing polymers, polyacrylontrile ethylene styrene, acrylic polymers, or combinations thereof. Exemplary conductive polymers can be, but are not limited to, carbon-based materials, conductive ceramic material, conductive alloys, a dielectric polymeric material coated with a conductive material, polyacetylene, polyethylenedioxythiophene, polypyrrole, polythiophene, polyethyne, polyaniline, poly (p-phenylene), poly (phenylene vinylene), or combinations thereof.

Other embodiments of the present disclosure provide a polishing pad for polishing a substrate, the pad comprising a layer of material having an upper polishing surface and a lower surface interfacing with a proximate platen. The pad material comprises a mixture of a conductive polymer ($CP_Y$) distributed in a structure of a dielectric polymeric material, the structure defined by a first component ($A_X$) and a second component ($B_Z$) in the relationship —$\{B_Z$—$CP_Y$-$A_X$-$CP_Y$—$B_Z$—$CP_Y$-$A_X$-$CP_Y\}_n$— where n represents a predetermined number of molecular units. Some embodiments of the present disclosure provide a conductivity of between approximately $10^{-5}$ S/cm to approximately $10^5$ S/cm, a hardness of between approximately 10 Shore A to approximately 80 Shore D, a density of between approximately 0.2 g/ml to approximately 1.2 g/ml and/or a compressibility of between approximately 1% to approximately 20%. In other embodiments, the weight percentage of the conductive polymer is less than or equal to approximately fifty percent of the total weight of the pad. Exemplary dielectric polymeric material can be but is not limited to, polyamides, polyimides, nylon polymer, polyurethane, polyester, polypropylene, polyethylene, polystyrene, polycarbonate, diene containing polymers, polyacrylontrile ethylene styrene, acrylic polymers, or combinations thereof. Exemplary conductive polymers can be, but are not limited to, carbon-based materials, conductive ceramic material, conductive alloys, a dielectric polymeric material coated with a conductive material, polyacetylene, polyethylenedioxythiophene, polypyrrole, polythiophene, polyethyne, polyaniline, poly (p-phenylene), poly (phenylene vinylene), or combinations thereof.

Various embodiments of the present disclosure provide a polishing pad for polishing a substrate comprising a layer of dielectric polymeric material having an upper polishing surface and a lower surface interfacing with a proximate platen. The layer includes a first set of grooves extending from the upper polishing surface to the lower surface, the first set of grooves filled with a conductive polymer and a second set of grooves shallower than the first set of grooves, the second set of grooves providing for slurry flow over the upper polishing surface. In some embodiments, between one to thirty first grooves separate two proximate second grooves. Exemplary dielectric polymeric material can be, but is not limited to, polyamides, polyimides, nylon polymer, polyurethane, polyester, polypropylene, polyethylene, polystyrene, polycarbonate, diene containing polymers, polyacrylontrile ethylene styrene, acrylic polymers, or combinations thereof. Exemplary conductive polymers can be, but are not limited to, carbon-based materials, conductive ceramic material, conductive alloys, a dielectric polymeric material coated with a conductive material, polyacetylene, polyethylenedioxythiophene, polypyrrole, polythiophene, polyethyne, polyaniline, poly (p-phenylene), poly (phenylene vinylene), or combinations thereof. In other embodiments, the first and/or second set of grooves are provided in a pattern such as, but not limited to, discontinuous radial lines, discontinuous concentric circles, discontinuous grid lines, continuous radial lines, continuous concentric circles, continuous grid lines, linear grooves, arcuate grooves, annular concentric grooves, radial grooves, helical grooves, intersecting X-Y patterns, intersecting triangular patterns, or combinations thereof. In additional embodiments, the area percentage of the conductive polymer is less than or equal to approximately forty percent of the total pad area. In other embodiments, the layer of dielectric polymeric material further comprises a mixture of a conductive polymer ($CP_Y$) distributed in a structure of a dielectric polymeric material, the structure defined by a first component ($A_X$) and a second component ($B_Z$) in the relationships —$\{B_Z$-$A_X$-$CP_Y$—$B_Z$-$A_X$-$CP_Y\}_n$— or —$\{B_Z$—$CP_Y$-$A_X$-$CP_Y$—$B_Z$—$CP_Y$-$A_X$-$CP_Y\}_n$— where n represents a predetermined number of molecular units.

It can be emphasized that the above-described embodiments, particularly any "preferred" embodiments, are merely possible examples of implementations, merely set forth for a clear understanding of the principles of the disclosure. Many variations and modifications can be made to the above-described embodiments of the disclosure without departing substantially from the spirit and principles of the disclosure. All such modifications and variations are intended to be included herein within the scope of this disclosure and the present disclosure and protected by the following claims.

Further, the foregoing has outlined features of several embodiments so that those skilled in the art can better understand the detailed description that follows. Those skilled in the art should appreciate that they can readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they can make various changes, substitutions and alterations herein without departing from the spirit and scope of the present disclosure.

As shown by the various configurations and embodiments illustrated in FIGS. 1-4F, various conductive CMP polishing pads have been described.

While preferred embodiments of the present disclosure have been described, it is to be understood that the embodiments described are illustrative only and that the scope of the invention is to be defined solely by the appended claims when accorded a full range of equivalence, many variations and modifications naturally occurring to those of skill in the art from a perusal hereof.

We claim:

1. A polishing pad comprising:

a layer of material having an upper polishing surface and a lower surface, the layer of material comprising a copolymer of a conductive polymer ($CP_Y$) and a dielectric polymeric material comprising a first component (Ax) and a second component (Bz), wherein the copolymer has the formula, $$—\{B_Z A_X CP_Y—B_Z A_X CP_Y\}_n— \quad (1)$$

where n represents a number of molecular units; and a set of channels extending from the upper polishing surface to the lower surface, the set of channels filled with a conductive polymer.

2. The polishing pad of claim 1 wherein the pad has a conductivity of approximately $10^{-5}$ S/cm to approximately $10^5$ S/cm and a hardness of approximately 10 Shore A to approximately 80 Shore D.

3. The polishing pad of claim 1 wherein the pad has a density of approximately 0.2 g/ml to approximately 1.2 g/ml and a compressibility of approximately 1% to approximately 20%.

4. The polishing pad of claim 1 wherein the weight percentage of the conductive polymer ($CP_Y$) is less than or equal to approximately fifty percent of the total weight of the pad.

5. The polishing pad of claim 1 wherein the dielectric polymeric material is selected from the group consisting of polyamides, polyimides, nylon polymer, polyurethane, polyester, polypropylene, polyethylene, polystyrene, polycarbonate, diene containing polymers, polyacrylontrile ethylene styrene, acrylic polymers, and combinations thereof.

6. The polishing pad of claim 1 wherein the conductive polymer ($CP_Y$) or the conductive polymer in the set of channels is selected from the group consisting of polyacetylene, polyethylenedioxythiophene, polypyrrole, polythiophene, polyethyne, polyaniline, poly (p-phenylene), poly (phenylene vinylene), and combinations thereof.

7. The polishing pad of claim 1, wherein the set of channels are provided in a pattern selected from the group consisting of discontinuous radial lines, discontinuous concentric circles, discontinuous grid lines, continuous radial lines, continuous concentric circles, continuous grid lines, linear grooves, arcuate grooves, annular concentric grooves, radial grooves, helical grooves, intersecting X-Y patterns, intersecting triangular patterns, and combinations thereof.

8. The polishing pad of claim 1, wherein the set of channels are provided in a pattern selected from the group consisting of discontinuous radial lines, discontinuous concentric circles, discontinuous grid lines, and combinations thereof.

9. The polishing pad of claim 1, wherein the set of grooves are provided in a pattern selected from the group consisting of discontinuous radial lines, discontinuous concentric circles, discontinuous grid lines, continuous radial lines, continuous concentric circles, continuous grid lines, linear grooves, arcuate grooves, annular concentric grooves, radial grooves, helical grooves, intersecting X-Y patterns, intersecting triangular patterns, and combinations thereof.

10. A method, comprising polishing a substrate using the polishing pad of claim 1.

11. The method of claim 10, wherein the set of channels are provided in a pattern selected from the group consisting of discontinuous radial lines, discontinuous concentric circles, discontinuous grid lines, and combinations thereof.

12. A polishing pad comprising:

a layer of material having an upper polishing surface and a lower surface as a bottom surface, the layer of material comprising a copolymer of a conductive polymer ($CP_Y$) and a dielectric polymeric material comprising a first component (Ax) and a second component (Bz), wherein the copolymer has the formula, $$—\{B_Z\text{-}A_X\text{-}CP_Y—B_Z\text{-}A_X\text{-}CP_Y\}_n— \quad (I)$$

where n represents a number of molecular units;

a set of channels extending from the upper polishing surface to the lower surface, the set of channels filled with a conductive polymer; and a set of grooves on the upper polishing surface, the set of grooves being shallower than the set of channels.

13. The polishing pad of claim 12 wherein the dielectric polymeric material is selected from the group consisting of polyamides, polyimides, nylon polymer, polyurethane, polyester, polypropylene, polyethylene, polystyrene, polycarbonate, diene containing polymers, polyacrylontrile ethylene styrene, acrylic polymers, and combinations thereof.

14. The polishing pad of claim 12 wherein the conductive polymer ($CP_Y$) or the conductive polymer in the set of channels is selected from the group consisting of polyacetylene, polyethylenedioxythiophene, polypyrrole, polythiophene, polyethyne, polyaniline, poly (p-phenylene), poly (phenylene vinylene), and combinations thereof.

15. The polishing pad of claim 12 wherein the set of grooves are provided in a pattern selected from the group consisting of discontinuous radial lines, discontinuous concentric circles, discontinuous grid lines, continuous radial lines, continuous concentric circles, continuous grid lines, linear grooves, arcuate grooves, annular concentric grooves, radial grooves, helical grooves, intersecting X-Y patterns, intersecting triangular patterns, and combinations thereof.

16. The polishing pad of claim 12 wherein between one to thirty first channels separate two proximate grooves.

17. The polishing pad of claim 12 wherein the area percentage of the conductive polymer is less than or equal to approximately forty percent of the total pad area.

18. A polishing pad comprising:

a layer of material having an upper polishing surface and a lower surface, the layer of material comprising a copolymer of a conductive polymer ($CP_Y$) and a dielectric polymeric material, wherein the dielectric polymeric material is polyurethane (PU) comprising a first component (Ax) and a second component (Bz), wherein the copolymer has the formula, $$—\{PU—CP_Y\}_n \quad (I)$$

where n represents a number of molecular units; and a set of channels extending from the upper polishing surface to the lower surface, the set of channels filled with a conductive polymer.

19. The polishing pad of claim 18, wherein the conductive polymer ($CP_Y$) is polyaniline.

20. A method, comprising polishing a substrate using the polishing pad of claim 18.

* * * * *